US005961563A

United States Patent [19]

Overton

[11] Patent Number: 5,961,563

[45] **Date of Patent: *Oct. 5, 1999**

[54] ANTI-SWAY CONTROL FOR ROTATING BOOM CRANES

[75] Inventor: Robert H. Overton, Virginia Beach, Va.

[73] Assignee: Daniel H. Wagner Associates, Hampton, Va.

[ * ] Notice: This patent is subject to a terminal disclaimer.

[21] Appl. No.: 08/786,275

[22] Filed: Jan. 22, 1997

[51] Int. Cl.[6] ..... B66C 13/06

[52] U.S. Cl. ..... 701/50; 212/272; 212/273; 212/275

[58] Field of Search ..... 701/50; 212/147, 212/132, 275, 273, 272

[56] References Cited

U.S. PATENT DOCUMENTS

| | | | |
|---|---|---|---|
| 3,517,830 | 6/1970 | Virkkala | 212/132 |
| 5,117,992 | 6/1992 | Simkus, Jr. et al. | 212/147 |
| 5,526,946 | 6/1996 | Overton | 212/275 |

*Primary Examiner*—William A. Cuchlinski, Jr.
*Assistant Examiner*—Yonel Beaulieu
*Attorney, Agent, or Firm*—Wallace J. Nelson

[57] ABSTRACT

A process for anti-sway control of a rotating boom or other three-degree-of-freedom crane wherein the load is hoisted, at variable hoist lengths, by a cable suspended from a point that can be moved in space in three dimensions, either freely, or under known constraints. Initial acceleration of the load induces an initial sway to the load. A second lateral acceleration, equal to the first lateral acceleration, is scheduled to be applied one-half a sway period later to remove the sway induced by the first acceleration. A third acceleration is applied to correct for half the excess sway induced by hoisting, by non-linearities in the pendulum, and by crane platform motion; and a forth acceleration, of equal magnitude as the third but in the opposite direction, is scheduled for one-half a sway period later, to correct the remaining half of the excess sway energy. The first and third accelerations are constrained by the ability of the crane to execute them and to execute the delayed second and fourth accelerations. The lateral accelerations are applied additively, and repeated sequentially at a variable rate, to accelerate the load from its initial location to objective velocities and locations under controlled anti-sway conditions.

3 Claims, 6 Drawing Sheets

ANTI-SWAY CONTROL FOR ROTATING BOOM CRANES

FIELD OF THE INVENTION

This invention relates to crane control systems in general, and relates specifically to anti-sway control for rotating-boom or other three-degree-of-freedom cranes wherein the load is hoisted by a cable suspended from a point that can be moved in space in three dimensions, either freely, or under known constraints.

BACKGROUND OF THE INVENTION

Many cranes used in construction, shipping, and manufacture suspend the load by ropes ("falls") from a suspension point usually, but not always, the end of a boom or jib, that can be rotated ("slewed") and raised or lowered ("luffed"), providing motion of the suspension point in three-dimensional space. The height of the load is controlled by boom or jib luffing and/or by shortening or lengthening the falls ("hoisting"). Luffing and slewing cause the suspension point to move perpendicular to the line of the boom. It may or may not be possible to move that point in and out along that line (through, for example, telescoping the boom). Some crane configurations provide control in two or three degrees of freedom for some point on the falls other than the boom tip, using restraints such as taglines that run to the falls from near the base of the crane. Such mechanisms effectively move the suspension point to the point in the falls that is so controlled.

Regardless of the mechanism, if the suspension point is accelerated in more than one horizontal direction, the resulting pendulum motion ("sway") of the load is three-dimensional. When the suspension point is no longer being accelerated and the sway is within the "linear regime", the horizontal orbit of the load is elliptical. When the sway is large enough to be noticeably nonlinear, the orbit is similar to an ellipse that precesses in the direction of revolution.

Sway is a major problem in transporting loads quickly and safely, and results in huge costs to the construction, cargo-loading, and heavy manufacturing industries. In current practice, sway is minimized by keeping the suspension-point acceleration levels low, by the use of direct manual control of the load using tag lines, and by operator action in "catching" the load at the end of each move. All of these mechanisms slow the load-handling operation considerably, and additionally endanger the personnel involved.

The extent of motion of the suspension point is constrained by the physical dimensions and capabilities of the crane. For example, the crane may only be capable of luffing and slewing a single boom, wherein the suspension point is constrained to the surface of sphere. All boom-type cranes have a minimum distance from the boom base ("jib radius"), from which the load can be suspended. Other motion constraints are imposed by the load weight. For example, the load may have a maximum jib radius and a maximum lateral sway angle for a given load, due to stability and strength limitations of the crane structure.

The primary sources of sway are the actions of the crane itself and motion of the crane base. Additional, lesser causes are hoisting while swaying, non-vertical pick-up of the load, and forces on the load due to external agents such as wind and manual tagline manipulation.

The problem of controlling sway during operation of cranes of level-beam design, wherein the load is transported from a suspension mechanism moving horizontal along a single axis by moving a trolley out along a beam, has been studied extensively, and several automatic systems to solve that problem have been developed. In such level-beam cranes, sway induced by suspension-point accelerations and by hoisting is effectively planar, and can be efficiently and smoothly removed by a previously disclosed "double pulse" anti-sway control law whereby the sway induced by an initial acceleration is removed by a second acceleration of the same sign, magnitude, and duration, timed to commence one-half a sway period after commencement of the first pulse. To meet a given velocity reference, the first acceleration pulse is of sufficient length to accelerate to one-half the reference velocity; the second acceleration pulse then accelerates the trolley to the full reference velocity. To stop the load, the reference velocity is simply set to zero, and the same double-pulse method is applied to decelerate to this new reference without residual sway. The double-pulse approach for two-dimensional cranes is taught by U.S. Pat. Nos. 4,756,432, 3,517,830, 5,127,533 and 5,526,946.

In the three-dimensional case of the present invention, the anti-sway problem is complicated by the fact that the desired accelerations and velocities are vectors rather than scalars, and that these vectors may not be attainable within the constraints. Furthermore, the sway in two arbitrary horizontal directions is a coupled motion.

Accordingly, while a number of anti-sway approaches apply to cranes wherein the motion of the load suspension point is constrained to a straight, horizontal line, no such law has been previously applied successfully to rotating-boom or other three-degree-of-freedom systems, where the pendulum swings in three dimensions rather than two.

SUMMARY OF THE INVENTION

It is an object of the present invention to provide a system to control three-dimensional suspension-point accelerations such that the reference velocity is met exactly, hoist-induced sway is fully corrected, and externally-induced sway can be removed, within constraints imposed by crane structure, motor capabilities, and load weight.

Another object of the present invention is a safe control for minimizing sway in movement of loads by a rotating-boom crane.

A further object of the present invention is an automated, anti-sway control system for rotating-boom cranes that can be co-controlled by the crane operator, can be overridden by the crane operator, and is also capable of being operated in the manual mode by the crane operator.

According to the present invention the foregoing and additional objects are attained by providing a process to govern the motion of a suspension point from which a load is suspended, by cables or other means, at a variable height, either with or without motion of the crane platform, in such a manner as to meet load velocity and position objectives without pendulum motion ("sway") of the load. In the absence of a load, the process of the present invention controls the suspension point so as to meet velocity and position objectives for the load attachment mechanism, without sway.

BRIEF DESCRIPTION OF THE DRAWINGS

A more complete appreciation of the invention and many of the attendant advantages thereof will be better understood when considered in connection with the accompanying drawings wherein.

DETAILED DESCRIPTION

Figure 1:
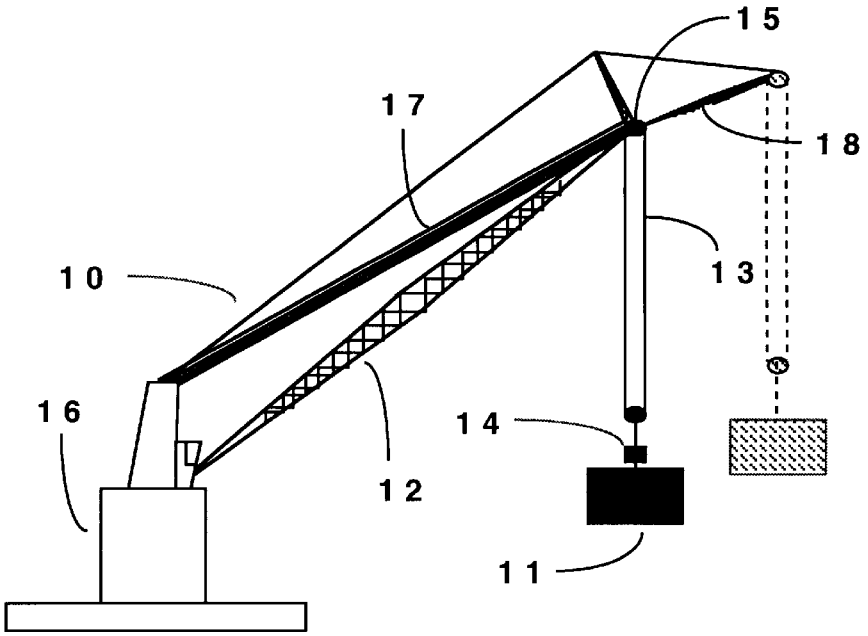
FIG. 1 is a schematic representation of a rotating-boom crane employed in the process of the present invention.

Referring now to the drawings and more particularly to FIG. 1, a rotating boom general crane 10, of the type to which the present invention pertains, is shown. As shown therein, a load 11 is suspended from the tip of a boom 12 by falls 13 connected to a load-attachment device 14 which is releasably attached to load 11. The load suspension point 15 is controlled by slewing boom 12 around its pedestal 16 and by luffing it using cables 17, or other structure.

A wide range of other crane configurations may also be used, including use of a separate jib 18, along with complex linkage to keep the load level when luffing, and control of boom luff by mechanical leverage rather than by support ropes. The key unifying feature for practice of the present invention is that load 11 is suspended in such a way that three-dimensional pendulum motion thereof is possible.

Figure 2:
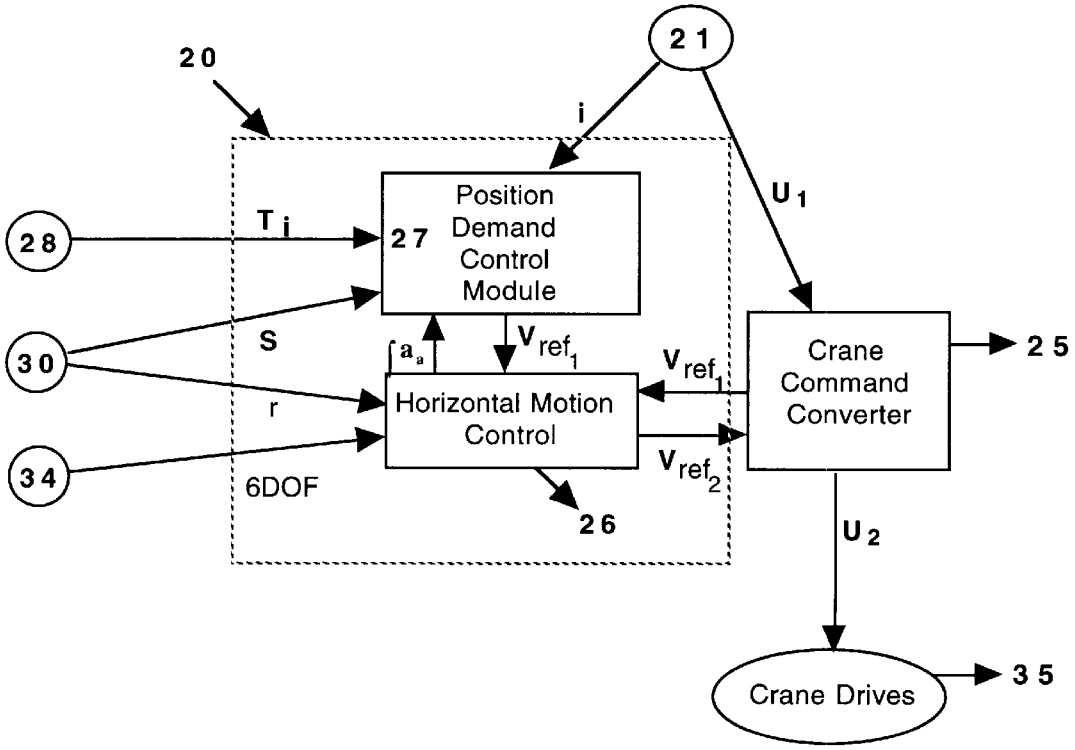
FIG. 2 is a schematic representation of a control system employed in the process of the present invention to control sway in the example crane shown in FIG. 1.

Referring now to FIG. 2, the process of the present invention is schematically shown inside the dashed block rectangle generally designated by reference numeral 20. The invention operates in Manual Anti-Sway mode, wherein the load 11 or load attachment device 14 is moved at an operator-selected velocity, and in Position Demand mode, wherein the load 11 or load attachment device 14 is moved to a designated target location. In operation, if the crane operator or other external authority, represented by oval 21, selects crane operation in Manual Anti-Sway mode, then inputs designated as $U_1$ in FIG. 2, received from the conventional controls indicating desired motions of the boom 12 and other machinery governing the boom tip position, are converted by Crane Command Converter 25 into a velocity reference ($^{V}\mathrm{ref}_1$), and passed to the Horizontal Motion Control 26. If the operator selects Position Demand mode, then the target identification, designated as "i" in FIG. 2, is input to the Position Demand Control 27. The horizontal position $T_i$ of the target is a required input from external sources, such as a system memory of the position of load suspension point 15 at the end of a previous move, or external sensors, or by other structure, as represented by circle 28. The current position of the load suspension point 15 (designated as S in FIG. 2), and length of the hoisting falls 13 (designated by r in FIG. 2), are required inputs to the Position Demand Control Module 27 and Horizontal Motion Control 26, respectively, from external sensors 30.

If the crane platform is unstable, the motion of the platform, in six degrees of freedom (6DOF) is a required input from external platform motion sensors 34. Optionally, the sway is read by external sensors, and externally-induced sway induced by outside agents such as wind and non-vertical lifting of the load is removed by the present invention.

The load is hoisted or lowered in a process external to the present invention, but the effect of such hoisting on load sway is compensated for by the invention. In the absence of such compensation, hoisting amplifies sway, and lowering of the load mitigates it.

If the operator selects a Position Demand move to a predetermined target, the Position Demand Module 27 calculates a horizontal trajectory for the suspension point to traverse from its current position to a point above the load destination ($T_i$). In the event that there are no externally-applied constraints on the load path, this trajectory is a straight line. Otherwise, it follows a pre-determined strategy; in the preferred implementation, the trajectory is composed of a sequence of straight paths, with an instantaneous stop at the end of each straight-line segment. No matter what the trajectory, the Position Demand Module 27 obtains the pending anti-sway accelerations ($\int_{a_a}$) from the Horizontal Motion Control 26, and then calculates the velocity reference vector vector ($^{V}\mathrm{ref}_1$) that will move the suspension point along the trajectory at any desired rate of which the crane is capable. The Position Demand Control Module 27 sends that velocity reference vector ($^{V}\mathrm{ref}_1$) to the Horizontal Motion Control 26.

The control objective of the Horizontal Motion Control 26 is to accelerate the suspension point in such a way that it, and the load, reach the desired horizontal reference velocity $^{V}\mathrm{ref}_1$, in an acceptable time, with no residual sway. The Horizontal Motion Control 26 is invoked at discrete times $\Delta t$ seconds apart, where $\Delta t$ is proportional to the sway period, and generates an acceleration vector a, according to the process as further described hereinafter. In the preferred implementation, the Horizontal Motion Control 26 generates an output reference velocity vector $^{V}\mathrm{ref}_2$, which is the previous vector modified by a acting over the time period $\Delta t$. As the control objective is met $^{V}\mathrm{ref}_2$ becomes. $^{V}\mathrm{ref}_1$ In alternative implementations, the acceleration vector a is a direct output to the Crane Command Converter 25 or direct to the Crane Drives 35.

The present invention meets the reference velocity by means of three interrelated controls, in the fashion of the previously disclosed anti-sway control for gantry cranes (U.S. Pat. No. 5,526,946 issued Jun. 18, 1996 to Overton). These controls are referred to therein, and herein, as the Response Control, the Sway Corrector, and the Antisway Control. These control mechanisms calculate acceleration vectors referred to as the Response Acceleration ($a_r$), the Correction Acceleration ($a_c$), and the Antisway Acceleration ($a_a$), respectively. The overall function of each component is as taught in this referenced Overton patent (which is incorporated herein by reference) with the exception that:

1. the outputs are vectors rather than scalars;
2. the Correction Acceleration $a_c$ is determined by a new formula described hereinafter, based on the position and velocity of the load, with its corresponding Anti-sway Acceleration vector a in the opposite direction from ac and with the same magnitude; and
3. new constraints are used, as indicated hereinafter.

To ensure that the acceleration can be carried out and that future anti-sway acceleration will be possible, the components $a_r$, $a_c$, and $a_a$ are given a strict priority of execution. In the present process, the Antisway Acceleration $a_a$ is always carried out, the Correction Acceleration $a_c$ is constrained given $a_a$, and the Response Acceleration $a_r$ is then constrained given $a_a$ and $a_c$. The three-dimensional constraint set is composed of two subsets of constraints, collectively referred to herein as the Immediate Constraint and The Future Constraint.

The Immediate Constraint is that:

1. the acceleration $a=a_a+a_c+a_r$ can be carried out immediately, i.e., $\|a\|\leqq\alpha_{max}$, where $\alpha_{max}$ is the maximum acceleration of the system, and
2. $^{V}\mathrm{ref}_2+\alpha\Delta t$, can be achieved by the crane-drive mechanisms.

The Future Constraint is that the scheduled anti-sway acceleration can be carried out a fixed number N of sample intervals later, where $N\Delta\tau$ is one-half a sway period. To calculate this constraint, the Antisway Control integrates all pending anti-sway accelerations, with initial velocity ${}^{V}\mathrm{ref}_2$, and integrates that velocity function, thus obtaining the predicted position $X_{pred}$ and velocity $V_{pred}$ of the suspension point (and load) when all anti-sway has been carried out. The Future Constraint is that 1. $a_{pred} = a_r - a_c$ must satisfy $\|a_{pred}\| \le a_{\max}$, and
2. $V_{pred} + a_{pred}\Delta t$ and $X_{pred} + a_{pred}\frac{\Delta t^2}{2}$ are realizable by the crane drives.

Collectively, the Immediate and Future Constraints define a subset of Euclidean space. The acceleration vector $a=a_a$ satisfies both constraints, so there is always a feasible solution (i.e., to simply carry out the scheduled anti-sway acceleration). In the present invention, $a_c$ is chosen to maximize sway-correction given $a_a$ and the constraint set and $a_r$ is chosen afterward, to maximize response to the operator (in Position Demand mode, response to the Position Demand Module) demands, given $a_a$, $a_c$, and the constraint set.

All calculations described herein are made by computer and incorporated into the automatic crane controls. The sway induced by hoisting, by suspension-point accelerations, and by non-linearity in the system response is monitored, using an internal nonlinear model of crane response given by:

$$\ddot{X} = -\left(\frac{s^2 + G\cdot X - r\ddot{r} - A\cdot X}{r^2}\right)X + G - A$$

where

X is the load position, s is the tangential speed of the load,

G is the acceleration due to gravity, r is the hoist length, and

A is the three-dimensional acceleration of the suspension point.

All these variables are measured relative to the suspension point in a rectilinear coordinate frame.

The Correction Control reduces by half all sway induced by crane platform motion, hoisting, and vertical suspension-point accelerations. If optional external feedback sensors are employed to sense sway caused by forces outside the crane, the Correction control determines $a_c$ to correct half the excess sway energy due to those forces as well, according to the differential equation for change in total sway energy derived from the nonlinear model, in the absence of hoisting:

$$E_{sway} = -A\cdot X$$

This equation quantifies the change in the total sway energy due to acceleration of the suspension point, and shows that, for a given acceleration magnitude, the optimum acceleration of the suspension point to remove sway energy is in the same direction as load motion. In the preferred implementation, $a_c$ is a vector in the plane perpendicular to the boom, in the direction of the projection of X into that plane. In alternative implementations, $a_c$ is a vector in the horizontal plane, or in some other plane determined by the crane design, in which suspension-point movements can be made. The unconstrained magnitude of $a_c$ is given by $$\|a_c\| = \frac{\Delta E_{sway}}{2_{s_T\Delta t}}$$

where $\Delta E_{sway}$ is the sway energy to be removed by $a_c$, $S_T$ is the speed of the load projected onto the plane of $a_c$, measured relative to the suspension point, and $\Delta t$ is the control sample time interval.

The anti-sway acceleration $a_a$ is equal to the difference between the response and correction accelerations $a_r$ and $a_c$, delayed by one half-period.

The efficacy of this strategy in removing three-dimensional crane-induced sway is shown in FIGS. 3*a*–3*e*. These FIGS display a computer-simulated sequence of developments in the horizontal orbit of a load, as viewed from the suspension point, when the suspension point is accelerated according to the process of the present invention, given an initial three-dimensional sway, no hoisting, and no sway feedback. The presence of initial sway serves to give a sense of time in these FIGS that would not be present were the initial conditions zero. As there is no feedback in the illustrated process, the objective of the Antisway Control in this situation is to achieve the specified velocity demand while restoring the initial sway.

Figure 3A:
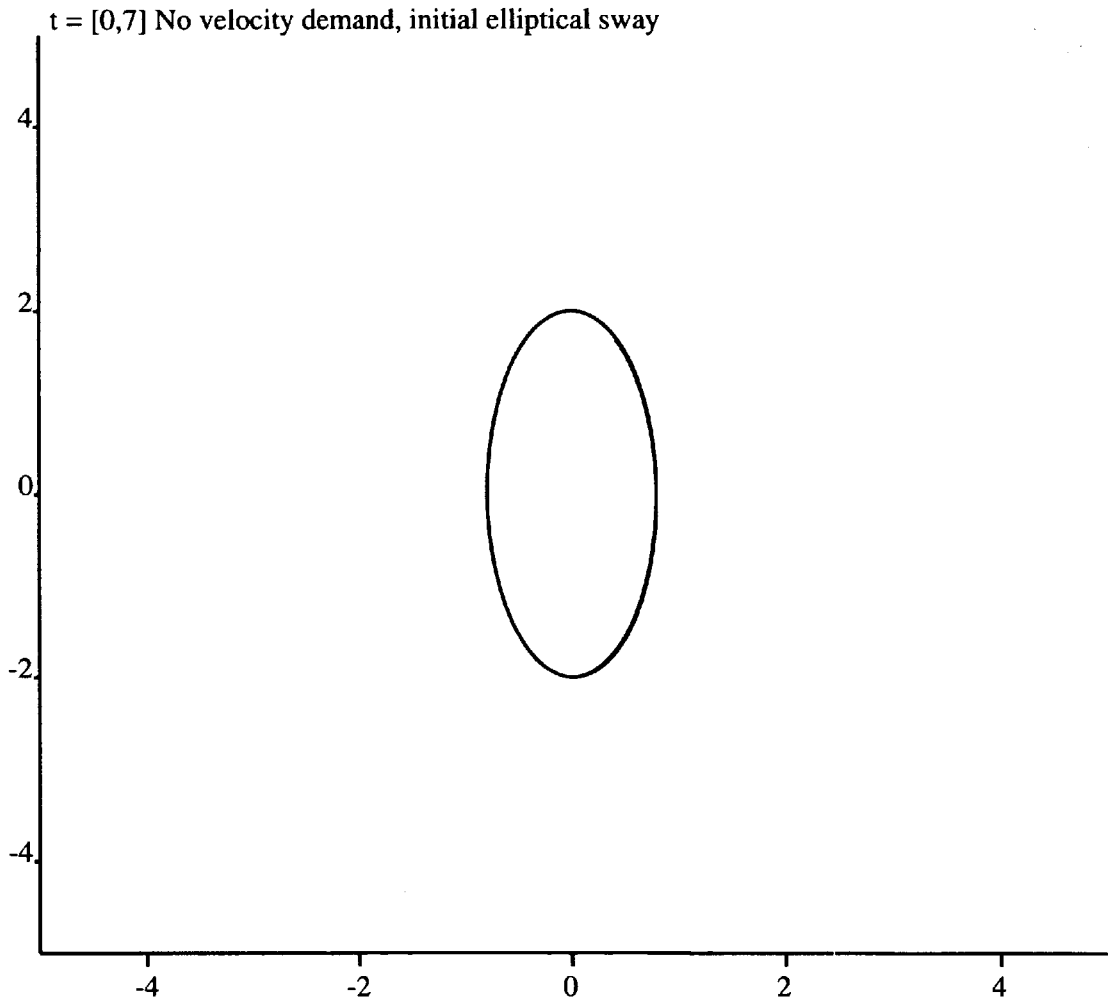
FIGS. 3*a*–3*e* illustrate a sequence of horizontal orbits of a free swinging load suspended from the crane of FIG. 1 during a sequence of boom-tip accelerations using the anti-sway process of the present invention.

In FIG. 3*a,* the initial elliptical orbit for a load is shown. At an arbitrarily chosen moment, when the load is in the upper right quadrant of the ellipse, an arbitrary velocity demand of $V_x=5$, $v_y=5$ is imposed.

Figure 3B:
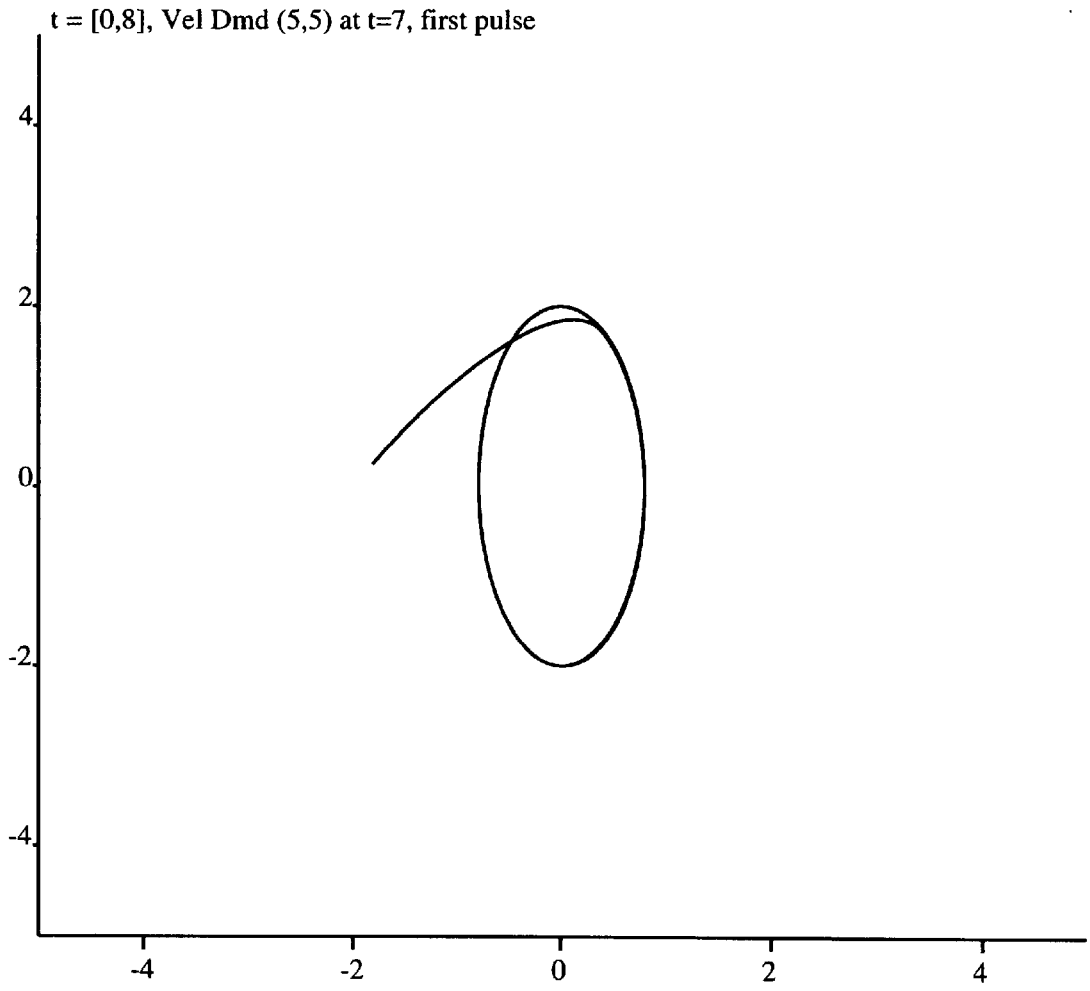

FIG. 3*b* shows the orbit as the Horizontal Motion Control responds with an initial acceleration $a=a_r=(3.176,3.176)$, the maximum rated velocity of the modeled crane.

Figure 3C:
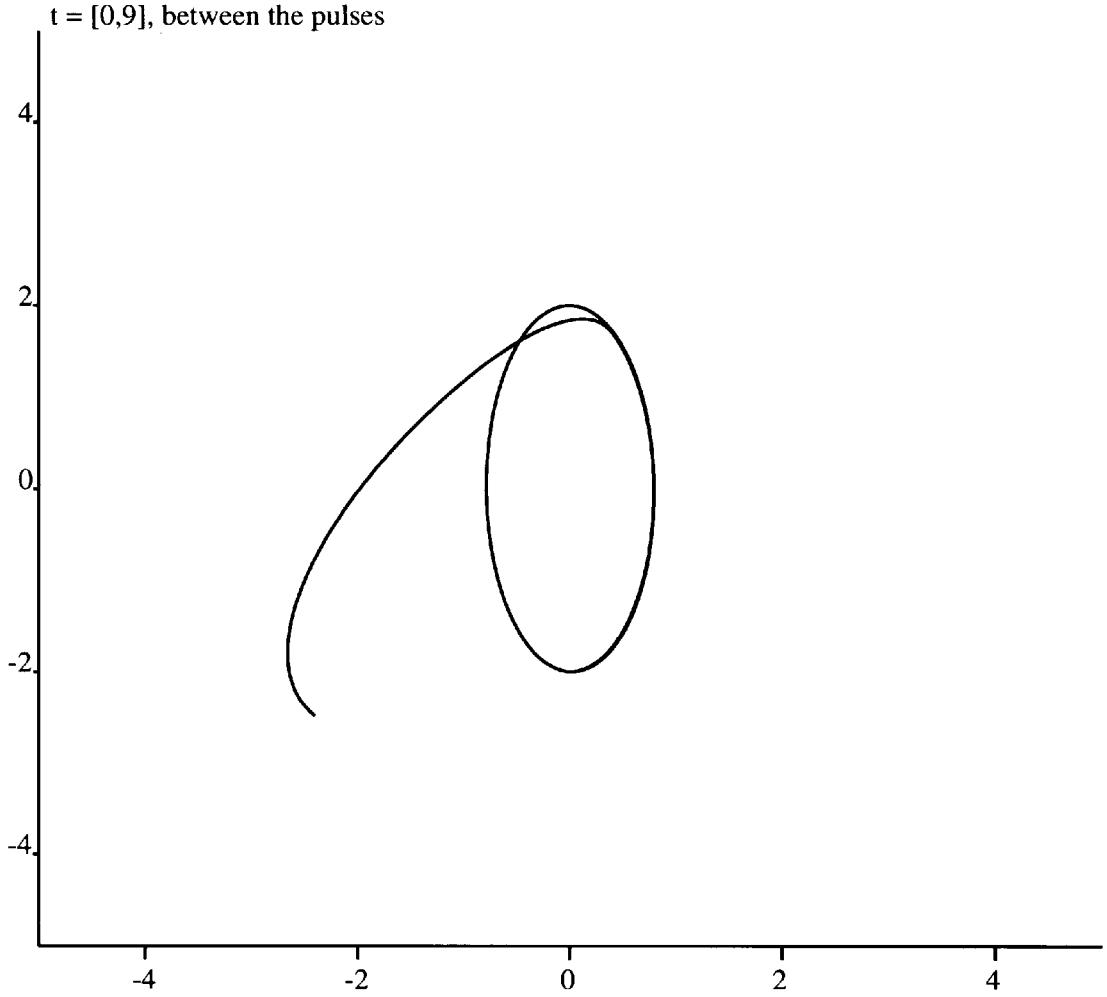

FIG. 3*c* shows the load orbit after half the velocity demand has been attained, the Horizontal Motion Control outputs ${}^{V}\mathrm{ref}_2=(2.5,2.5)$ and the suspension point moves at a constant velocity.

Figure 3D:
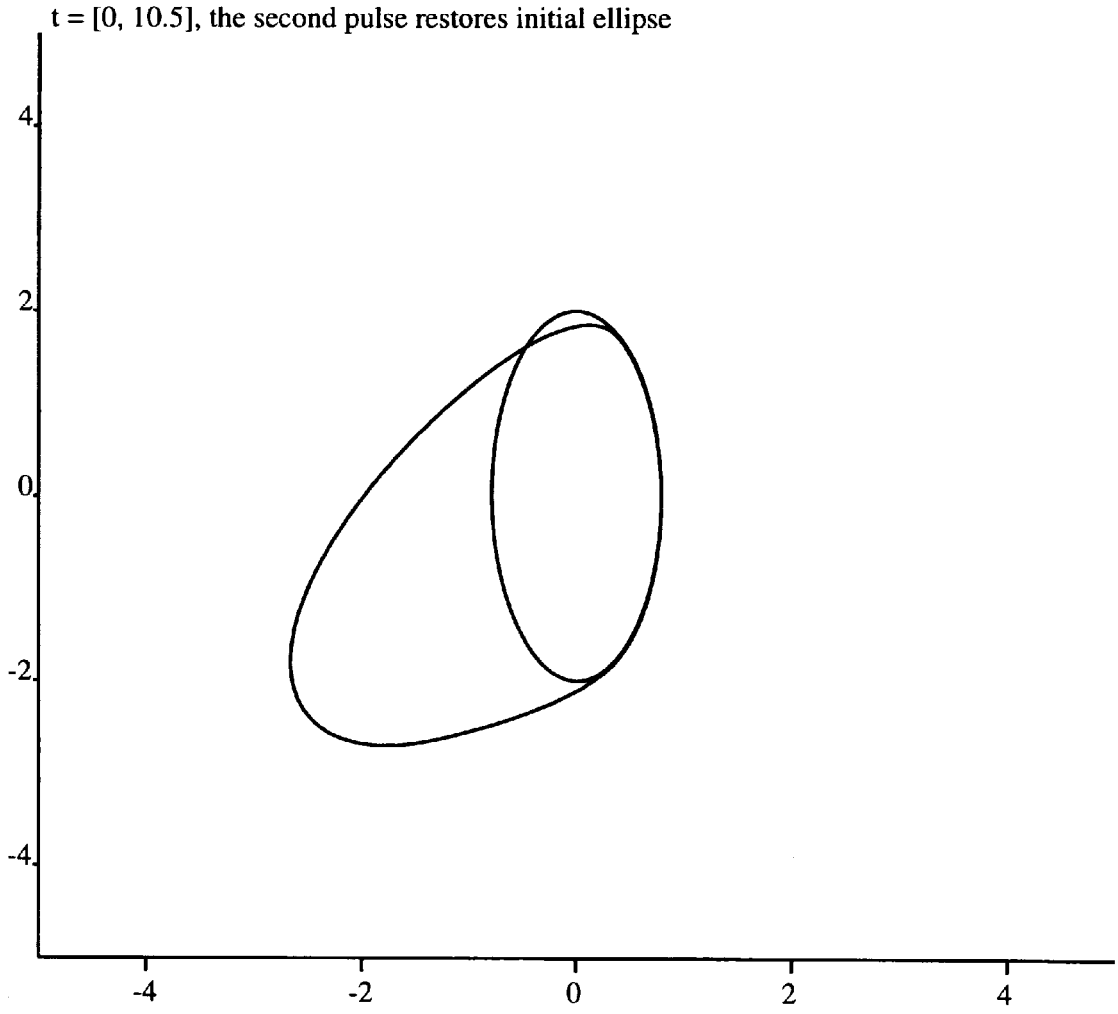

FIG. 3*d* shows the orbit when the Horizontal Motion Control accelerates the suspension point again, at $a=a_a=(3.176,3.176)$, for the same time interval as for the first acceleration, until the velocity demand, ${}^{V}\mathrm{ref}_2=(5,5)$, has been met. The original elliptical sway has been restored.

Figure 3E:
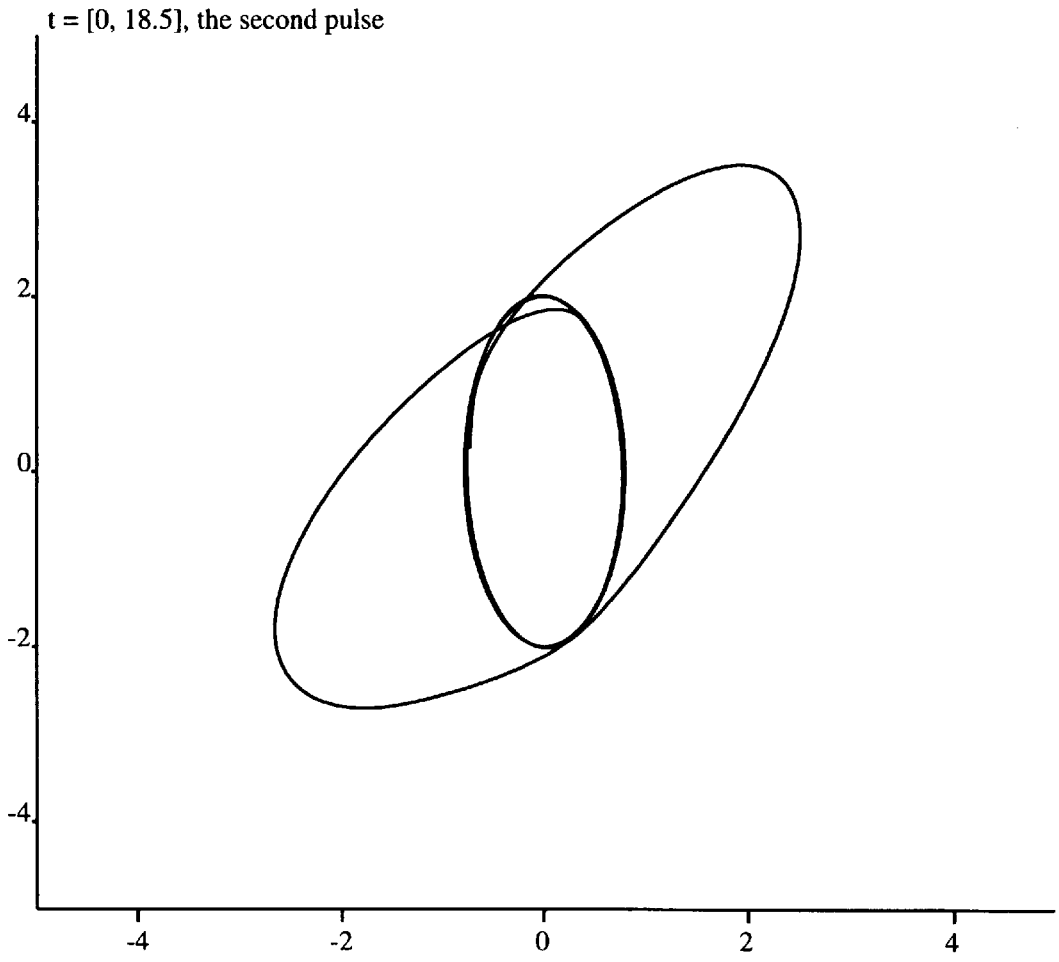

FIG. 3*e* shows the orbit of the load after the velocity demand is set to zero, commanding a stop, and after the Horizontal Motion Control decreases ${}^{V}\mathrm{ref}_2$ to (2.5,2.5), holds it at that level, and then decreases it again to (0.0,0.0). The terminal sway is identical to the initial sway.

It is thus seen that the invention provides a reliable and valuable control process for controlling sway in a load suspended from a point that can be manipulated in three dimensions, as with a rotating boom crane. Although the invention has been described relative to specific embodiments thereof, it is not so limited and there are numerous variations and modifications thereof that will be readily apparent to those skilled in the art in the light of the above teachings. It is therefore to be understood that, within the scope of the appended claims, the invention may be practiced other than as specifically described herein.

What is claimed as new and desired to be secured by Letters Patent of the United States is:

1. A method for controlling the motion of a crane supported, movable suspension point for a load suspended at a variable hoist length therefrom, to meet an arbitrary horizontal velocity reference while preventing sway of the load, by employing a computer-controlled control law and comprising the steps of:

(a) utilizing computer controls for moving the suspension point to accelerate the suspended load from an initial velocity to a second velocity and inducing an initial sway to the load when initially moved, (b) scheduling a first lateral anti-sway acceleration vector, to be applied one-half a sway period late, to damp the sway induced by the initial load attachment point acceleration, (c) determining an immediate lateral correction acceleration vector to reduce by a factor of one-half the sway energy contributed by (1) hoisting the load while swaying, (2) non-linearities in the pendulum load motion, (3) crane platform motion, and (4) external forces, (d) scheduling a second lateral anti-sway acceleration, having the same magnitude as the correction acceleration but in the opposite direction, to be applied one-half a sway period later to correct the remaining half of the excess sway energy, (e) applying, additively, at the designated times, the lateral accelerations of steps (a) through (d) to accelerate the load attachment point, (f) repeating each of steps (a) through (e) at a sampling interval proportional to the sway period.

2. The method of claim 1 including the step of employing constraints on the initial acceleration and on the correction acceleration, comprised of:

(a) an immediate constraint imposed by the requirement that the sum of all immediate accelerations and all pending anti-sway accelerations be implementable by the crane and crane drives, and (b) a future constraint imposed by the requirement that the scheduled anti-sway, equal to the difference between the initial acceleration and the correction acceleration, be implementable by the crane and crane drives one-half sway period later.

3. A method of preventing hoist-induced sway of a load suspended by cables from a suspension point for motion in three dimensions comprising:

(a) applying a horizontal acceleration vector $a_c$ the load suspension point to exactly counter half the excess sway energy resulting from hoisting while the load is swaying, from motions of the load suspension point due to crane platform motion, and from non-linearities in the pendulum motion of the load, in the direction of the horizontal component of the load velocity vector and with magnitude $$\|a_c\| = \frac{\Delta E_{sway}}{2_{s_T \Delta t}}$$

where $\Delta E_{sway}$ is the excess sway energy to be removed, $S_T$ is the speed of the load projected onto the plane of motion of the suspension point and measured relative to the suspension point and $\Delta t$ is the control sample time interval; and (b) applying an additional lateral acceleration, having the same magnitude as $a_c$ but opposite direction, one-half a pendulum period later to correct the remaining half of the excess sway energy.

* * * * *

UNITED STATES PATENT AND TRADEMARK OFFICE

CERTIFICATE OF CORRECTION

PATENT NO. : 5,961,563
DATED : October 5, 1999
INVENTOR(S) : Robert H. Overton

It is certified that error appears in the above-identified patent and that said Letters Patent is hereby corrected as shown below:

Column 1,
Line 3, insert the following:
-- This invention was made with Government Support under N00014-97-C-0278 awarded by the Office of Naval Research. The Government has certain rights in the invention. --

Signed and Sealed this

Tenth Day of May, 2005

JON W. DUDAS
*Director of the United States Patent and Trademark Office*